US005127449A

United States Patent [19]

Mueller et al.

[11] Patent Number: 5,127,449

[45] Date of Patent: Jul. 7, 1992

[54] SERVO-CONTROLLED APPARATUS FOR FILLING CONTAINERS

[75] Inventors: Martin J. Mueller, Palm Harbor, Fla.; Martin Mueller, Wonder Lake, Ill.; Michael A. Weigandt, Duenden, Fla.

[73] Assignee: Osgood Industries, Inc., Oldsmar, Fla.

[21] Appl. No.: 638,395

[22] Filed: Jan. 7, 1991

[51] Int. Cl.[5] ..... B65B 3/12; B65B 37/06

[52] U.S. Cl. ..... 141/1; 141/242; 141/258; 141/260

[58] Field of Search ..... 141/237, 242, 244, 245, 141/258-262, 1

[56] References Cited

U.S. PATENT DOCUMENTS

| | | | |
|---|---|---|---|
| 1,690,067 | 10/1928 | Weeks | 141/242 |
| 3,695,486 | 10/1972 | Warner | 222/162 |
| 3,744,538 | 7/1973 | Nasica et al. | 141/242 |
| 3,934,625 | 1/1976 | Tiernan et al. | 141/258 X |
| 4,234,107 | 11/1980 | Gernlein | 222/309 |
| 4,373,560 | 2/1983 | Elsworth | 141/242 X |
| 4,974,755 | 12/1990 | Sonntag | 141/258 X |

*Primary Examiner*—William A. Cuchlinski, Jr.
*Assistant Examiner*—W. Morris Worth
*Attorney, Agent, or Firm*—Dressler, Goldsmith, Shore, Sutker & Milnamow Ltd.

[57] ABSTRACT

An apparatus for filling containers includes a food product fill pump having a valve member and pump piston operated by respective cam drives. A servo-controlled drive motor drives the cams, whereby the speed of the pump operation can be controlled independently of an associated container conveyor. Significantly, the servo-control of the apparatus permits the pump piston of the food pump to be operated during its container-filling advancing stroke at a substantially constant speed, while the pumping cycle time is selectively varied by selectively varying the speed of the piston retraction stroke.

8 Claims, 3 Drawing Sheets

SERVO-CONTROLLED APPARATUS FOR FILLING CONTAINERS

TECHNICAL FIELD

The present invention relates generally to an apparatus for continuously and sequentially filling containers with food product, and more particularly to a servo-controlled filling apparatus which is configured to permit selective operation of the apparatus independently of the operation of an associated container conveyor.

BACKGROUND OF THE INVENTION

Flowable food products, such as margarine, butter, or the like are typically packaged in individual containers for retail sale and consumer use. Packaging of these types of food products is ordinarily effected with the use of fill pump devices which are operated in conjunction with associated conveyors which move containers for filling relative to the filling devices. In this manner, the containers are presented in a continuous, sequential manner to the filling devices, with the devices operated to dispense the desired quantity of food product to each of the containers.

As will be appreciated, precise control of the filling devices is necessary in order to assure that each container receives the desired quantity of product. In practice, such precision can be difficult to achieve. In addition to the usual fluctuations in product consistency and temperature, the periodic start-up and shut-down of a filling line typically complicates accurate filling.

In the past, two types of filling systems have generally been employed. Pneumatically controlled systems typically include pneumatically-actuated pumping devices for dispensing the food product into the associated containers. These devices offer the distinct advantage of permitting the product piston of the typical food product pump to be advanced at a relatively constant speed during its advancing, container-filling stroke, irrespective of the overall cycle speed of the device. This has been found to be particularly advantageous in providing oil-based food products with the desired uniform appearance.

On balance, such pneumatic systems can be problematical due to the inevitable fluctuations in air supply pressure, the limited service life of the usual pneumatic cylinders, and the attendant problems of maintaining the various seals and like components of such a system. In summary, these types of systems do not provide the desired degree of dependability, resulting in undesirable down time, and can undesirably result in fluctuating weight control.

In contrast, the other type of typical food product filling system is cam-operated, and is ordinarily mechanically linked to the drive for the associated container conveyor. Cam operation of the food product pump of this type of system has been found to desirably provide superior weight control, when compared to pneumatic systems, and desirably consistent operation of the pump devices. This type of system desirably avoids problems associated with fluctuations in product supply pressure and air supply pressure, and imprecise operator control.

Despite certain advantages, such cam-operated systems cannot deliver the desired pump piston velocity during initial start-up of the filling line, which can adversely affect the appearance of the food product with which the containers are being filled. Additionally, such systems lack versatility, since typically the system performs optimally within a limited speed range, and thus does not lend itself to running at higher or lower speeds. When the system is run at other than its optimal speed, undesirably high product reject rates result.

The present invention seeks to overcome the disadvantages associated with filling systems heretofore employed by permitting versatile operation of a filling system while maintaining the desired quality of product appearance under a wide variety of operating conditions.

SUMMARY OF THE INVENTION

The filling apparatus embodying the principles of the present invention is configured for use with an associated container conveyor for continuous and sequential filling of containers with food product. Notably, in distinction from systems heretofore employed, the present system includes a servo-controlled drive arrangement which operates through a system of cams for effecting control of product pumping independently of the operation of the container conveyor. Significantly, the present servo-controlled apparatus permits the pumping cycle time of the apparatus to be selectively varied, even though the product pumping piston of the apparatus is advanced at a substantially constant rate during its product-pumping, advancing stroke. Highly versatile operation is thus possible, with the quality and appearance of the food product maintained at a desirably high level.

In accordance with the illustrated embodiment, the present apparatus includes a food product pump having an outlet positionable in operative association with the associated container conveyor. The pump includes a housing which defines a pump chamber, and a pump piston reciprocably movable in the pump chamber. In this manner, during each pumping cycle: (1) food product can be received in the pump chamber from an associated product supply during a retraction stroke of 35 the pump piston, and (2) food product can be moved from the pump chamber by the pump piston and through the outlet of the pump into one of the containers during advancing stroke of the piston.

In the illustrated form, the food product pump includes a pump valve which is operable in cooperation with the pump piston. The pump valve is movable between a first position, wherein the pump chamber is joined in fluid communication with the associated product supply during the retraction stroke of the piston, and a second position wherein the pump chamber is joined in fluid communication with the pump outlet during the advancing stroke of the piston.

While the present apparatus can be embodied in a number of forms, the illustrated form of the food pump includes a plurality of the pump chambers, and a plurality of pump pistons movable in tandem, each in a respective one of the pump chambers. A plurality of the pump valves are likewise provided, with the pump valve operable in tandem in respective association with the pump chambers and pistons.

In accordance with the present invention, a servo-controlled drive arrangement is operatively connected with the food product pump for driving the one or more pump pistons. Notably, the servo-controlled drive is operable to control the pumping cycle of the food product pump independently of the speed at which containers are being conveyed by the associated container conveyor.

Most significantly, the servo-controlled drive is operable to permit the speed at which the pump piston is driven during its retraction stroke to be selectively adjusted independently of the speed at which the pump piston is driven during its advancing stroke. This feature of the present system facilitates operation of the food product pump so that the pump piston can be operated at a substantially constant speed during each of its advancing strokes, while the time period for each pump cycle can be selectively varied (by selectively varying the speed of the retraction stroke). In this manner, the piston advancing speed can be selected to provide the optimal appearance and quality of the food product, yet the pump can be operated at a wide variety of selected speeds, independently of the container conveyor if desired, by varying the time of the retraction stroke for the pump piston.

Other features and advantages of the present invention will become readily apparent from the following detailed description, the accompanying drawings, and the appended claims.

DETAILED DESCRIPTION

Figure 1:
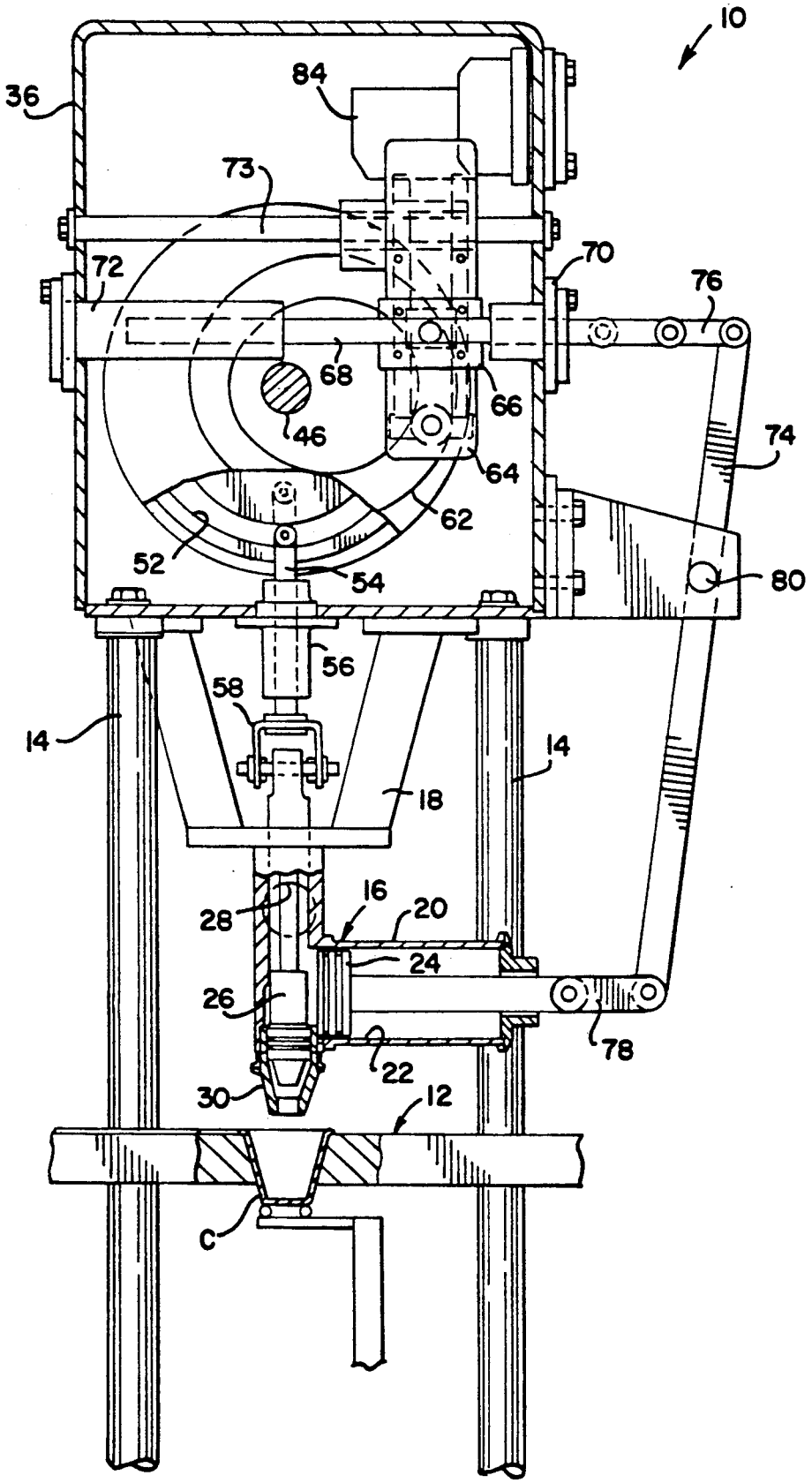
FIG. 1 is a diagrammatic, side elevational view, partially in cross-section and cut-away, illustrating a filling apparatus embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring now to the drawings, therein is illustrated a filling apparatus 10 embodying the principles of the present invention. As will be recognized by those familiar with the art, filling apparatus 10 is configured for use with an associated container conveyor 12 which conveys containers C generally beneath the filling apparatus 10 whereby the containers are continually and sequentially filled with food product. Filling apparatus 10 can be suitably employed for filling container C with flowable food product such as butter, margarine, or the like.

In keeping with the principles of the present invention, filling apparatus 10 is desirably straightforward in configuration for reliable and consistent operation with minimal maintenance. The apparatus 10 includes a generally upstanding frame 14 on which is mounted a food product pump 16 carried by mounting brackets 18.

Food product pump 16 is of a generally known configuration, including a pump housing 20 which defines at least one, and preferably a pair, of pump cavities 22. In accordance with the illustrated form, each pump cavity has positioned therein a respective reciprocable pump piston 24, which is driven, as will be further described, for pumping and dispensing food product to the associated containers C.

To this end, the food product pump 16 includes a pair of reciprocable valve members 26 respectively associated with the pump cavities 22 and the pump pistons 24. The valve members 26, which are preferably operable in tandem as the pump pistons 24 are likewise operated, act to control flow of food product from associate food product supply lines 28 into pump chambers 22, and out of pump outlets 30 into the associated containers.

Figure 3:
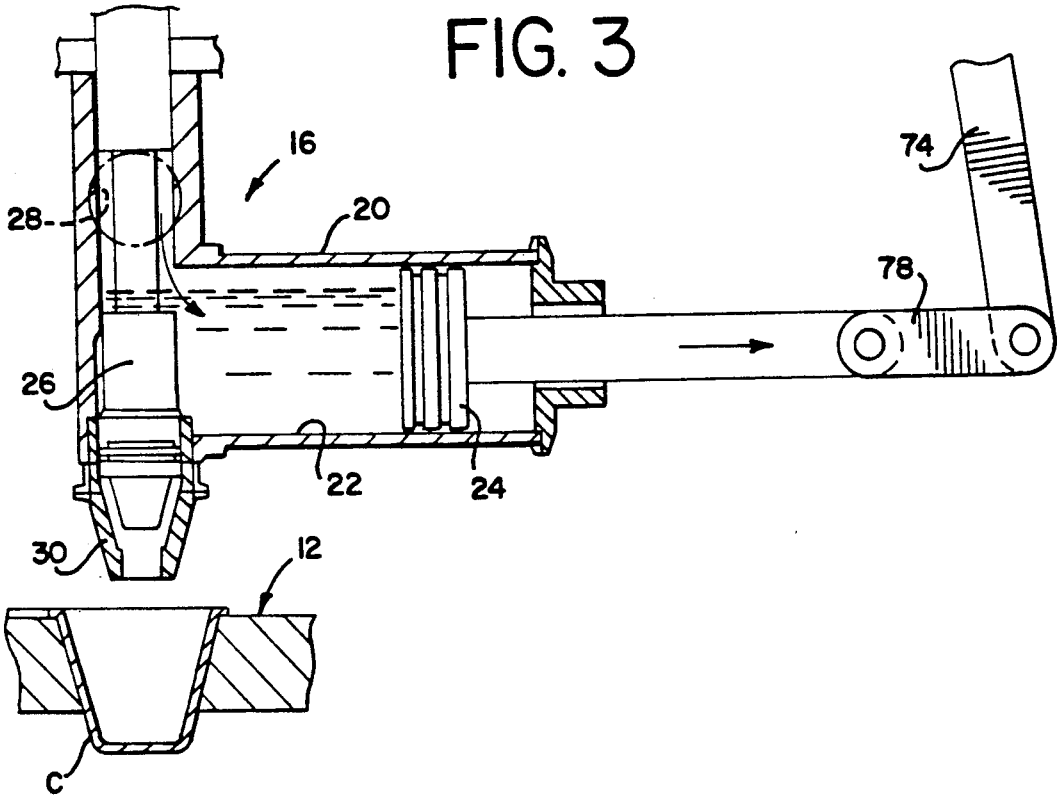
FIGS. 3 and 4 are diagrammatic views illustrating a pumping cycle of a food product pump of the present filling apparatus.

For each pumping cycle, each valve member 26 is positioned in a first, lower position, as shown in FIG. 3, whereby each pump chamber 22 is joined in fluid communication with the respective food product supply 28, and the respective outlet 30 of the pump is closed. During this portion of the pump cycle, pump piston 24 is moved through a retraction stroke, with the pump chamber 22 filling with the food product.

Figure 4:
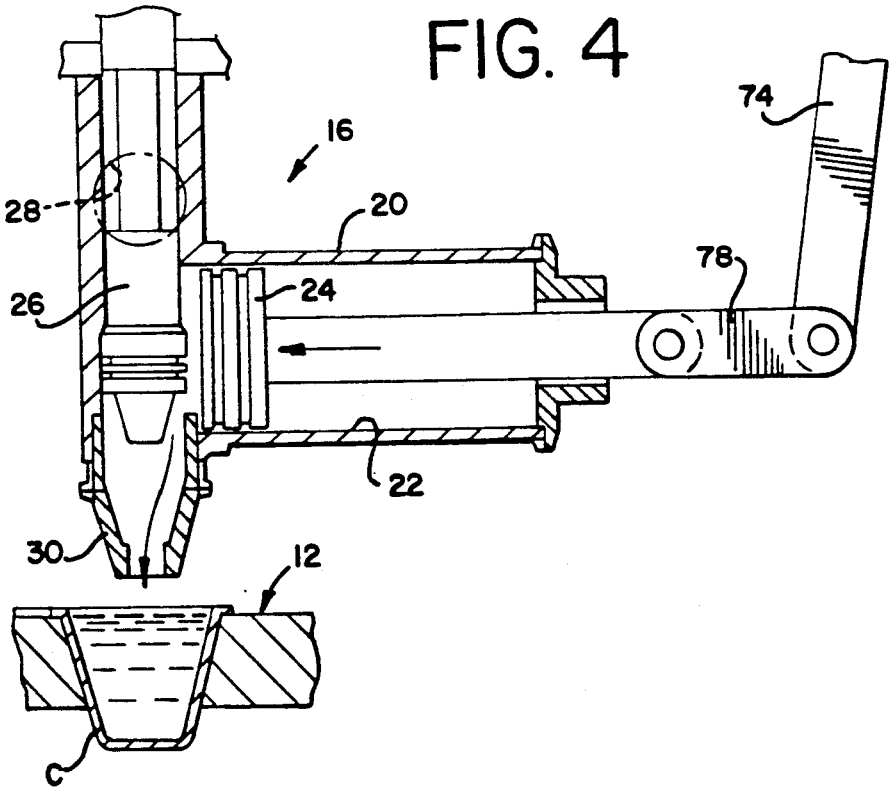

FIG. 4 illustrates completion of the pump cycle. During this portion of the cycle, each valve member 26 is moved to a second, upper position, which acts to close food product supply 28, and join piston chamber 22 in fluid communication with the pump outlet 30. During this portion of the cycle, the pump piston 24 is driven through an advancing stroke, thereby driving the food product from within the pump chamber and out of outlet 30 into one of the containers C on the conveyor 12.

The servo-controlled drive system of the present apparatus will now be described.

Figure 2:
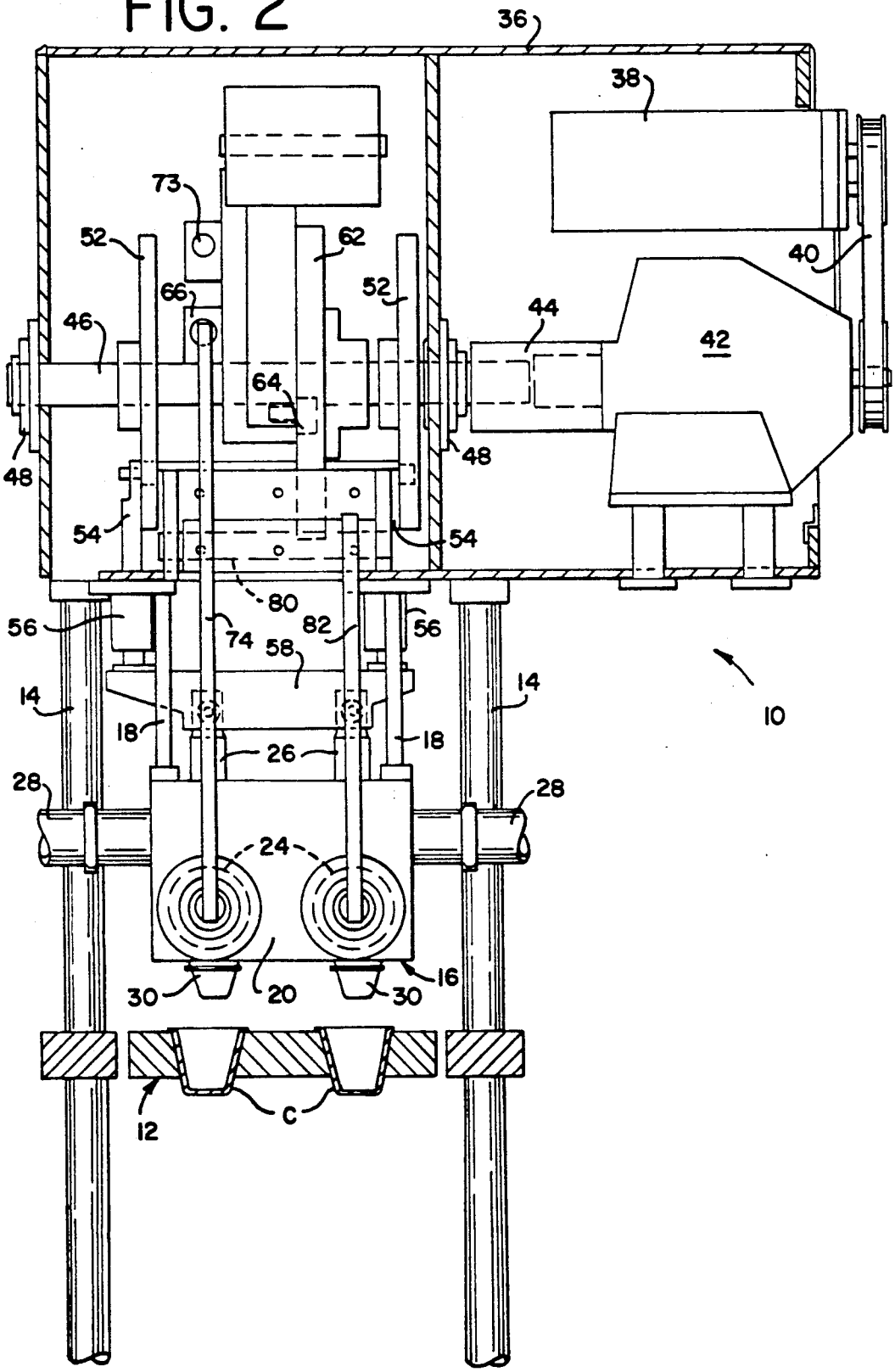
FIG. 2 is a diagrammatic, rear elevational view, partially in cross-section and cut-away, of the present filling apparatus.

With particular reference to FIGS. 1 and 2, apparatus 10 includes an upper housing 36 mounted on the frame 14. The housing 36 encloses a servo-controlled drive motor 38 such as comprising a unit manufactured by Allen Bradley, AC Servo-Motor Model No. 1328AB-B2G-11.

The drive motor 38 operates through a drive belt 40 to drive a reducer unit 42. The reducer unit 42 in turn operates through a drive coupling 44 to drive a horizontally arranged cam shaft 46 carried by suitable bearings 48 on the housing 36.

Cam shaft 46 is employed for driving suitable cams which effect the desired driven movement of both pump pistons 24 and the valve members 26 of the associated product pump 16. Specifically, a pair of valve actuating cams 52 are mounted on the cam shaft 46, with each of the cams 52 operating through a respective one of a pair of cam followers 54. Cam followers 54 are generally vertically movable, with the vertical movement of the cam followers guided by a pair of guides 56. The cam followers 54 are in turn joined to a valve yoke 58 which is joined to the pair of valve members 26 of the food product fill pump 16. Thus, the valve members are operated in tandem by the pair of valve actuating cams 52.

Reciprocable stroking of the pump pistons 24 is effected by a pump piston cam 62 commonly mounted on the cam shaft 46 together with valve actuating cams 52. A cam follower 64 comprises a generally vertically extending member having a roller follower at the lower end thereof. The follower 64 is joined to a bracket 66. The bracket 66 is in turn connected to a horizontally reciprocable rod 68 carried by a pair of linear bearings 70 and 72 mounted on the housing 36. Horizontal movement of cam follower 64 is assured by the provision of an upper guide rod 73 on which the cam follower is mounted by means of a suitable linear bearing.

Thus, rotation of the pump piston cam 62 effects horizontal movement of the cam follower 64, and like horizontal movement of the rod 68. Rod 68 in turn acts on a pump actuating arm 74 via a link 76, with the lower end of actuating arm 74 joined via a link 78 to one of the pump pistons 24. In order to effect movement of the other pump piston 24, the actuating arm 74 operates through a horizontal shaft 80, which in turn is joined to a second pump actuating arm 82 (FIG. 2) joined by a suitable link to the other pump piston 24.

By this construction, rotation of pump piston cam 62 by driven rotation of cam shaft 46 by servo-controlled drive motor 38, operating via reducer 42, reciprocably strokes pump pistons 24 in tandem. In the preferred embodiment, the cam profile of cam 62 effects movement of each pump piston through each of its advancing and retraction strokes attendant to each 180° of rotation of the cam 62 (i.e., 180° of rotation during the advancing stroke, and 180 of rotation during the retraction stroke). Similarly, the valve actuating cams 52 effect movement of the valve members 26 from their first and to their second positions attendant to 180° rotation of each of the cams 52, with a like 180° of rotation for returning the valve members from their second positions to their first positions.

In accordance with the illustrated embodiment, the filling apparatus includes a volume control mechanism generally designated 84. The volume control mechanism is of a known configuration, and is arranged to vertically adjust the position of cam follower 64 relative to bracket 66, thereby varying the effective stroke of rod 68 (and thus the effective stroke of pump pistons 24). In a typical configuration, the volume control mechanism 84 comprises a selectively operable servomotor which operates through a suitable vertical screw to raise and lower the cam follower 64 relative to the bracket 66. This preferred arrangement facilitates precise adjustment of the amount of food product delivered with each advancing stroke of the product pistons 24.

Suitable automatic, electronic controls facilitate the desired operation of the present filling apparatus. A signal from the container conveyor 12 is employed for coordinating operation of the filling apparatus with the conveyor, but in distinction from previous cam-actuated systems, the present apparatus can be selectively operated independently of the speed of the container conveyor. The servo-controlled drive motor 38 is operated via controls which monitor the food product fill pump drive speed and position, via a suitable encode and reader, thereby facilitating the desired individual control of the pump piston advancing stroke and pump piston retraction stroke.

In operation, the controls of the device are set to optimize product consistency and quality by establishing the preferred speed at which the pump pistons 24 are advanced during the advancing, filling stroke. The servo-controlled drive motor 38 permits this portion of each pump cycle to be consistently maintained.

In contrast, the present apparatus can be operated so that the retraction stroke of the pump pistons 24 is selectively adjusted and varied, thereby selectively adjusting and varying the pump cycle, while the speed of the advancing stroke is maintained.

By way of example, assuming the above-described cam profiles, wherein piston advancing and retraction each take place attendant to 180° of cam rotation, the desired product consistency might typically be achieved when the piston advancing stroke is set at a duration of 0.3 seconds. For overall operation at 60 revolutions per minute (i.e., 60 pump cycles per minute), piston retraction speed is set at a duration of 0.7 seconds. For operation at 80 revolutions per minute, piston retraction speed is set at a duration of 0.45 seconds, while the advancing stroke is still effected in 0.3 seconds. For operation at 40 revolutions per minute, piston retraction speed is set at 1.2 seconds, again with the advancing stroke maintained at 0.3 seconds. Thus, various fill rates, or pump cycle times, are readily achieved, even though the piston advancing stroke is maintained at a constant speed by virtue of the servo-controlled arrangement.

In summary, the present system permits the velocity of the pump pistons to be precisely controlled during any cycle speed for the apparatus by individual control of the advancing and retraction strokes. The system allows maximum torque during start-up, thereby providing product of the desired quality almost immediately upon start-up. Accurate weight control is achieved by virtue of the mechanical cam drive employed for operation of the pump pistons, with the desired reliability of such systems also achieved. Product appearance and quality will be consistent for virtually all containers, thus desirably abating rejects. The absence of pneumatic cylinders and the like provides a high degree of reliability not possible with pneumatic systems, while readily providing the desired consistency and quality control of such systems.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover by the appended claims all such modifications as fall within the scope of the claims.

What is claimed is:

1. An apparatus for filling containers being conveyed by an associated container conveyor, said apparatus comprising:

a food product pump having an outlet positionable in operative association with said conveyor, said pump comprising a housing defining a pump chamber, pump piston means reciprocably movable in said pump chamber to provide retraction and advancing strokes during each pumping cycle, and pump valve means operable in cooperation with said pump piston means, said pump valve means being movable between a first position wherein said pump chamber is joined in fluid communication with an associated product supply during said retraction stroke of said piston means, and a second position wherein said pump chamber is joined in fluid communication with said outlet during said advancing stroke of said piston means, so that during each pumping cycle: (1) food product can be received in said pump chamber from said associated product supply during said retraction stroke of said piston means, and (2) food product can be moved from said pump chamber by said piston means and through said outlet into one of said containers during said advancing stroke of said piston means; and servo-controlled drive means operatively connected to said food product pump for driving said reciprocable pump piston means, said servo-controlled drive means being operable to control the pumping cycle of said food product pump independently of the speed at which said containers are being moved by said associated container conveyor.

2. An apparatus for filing containers in accordance with claim 1, wherein said servo-controlled drive means is operable to permit the speed at which said pump piston means is driven during said retraction stroke to be selectively adjusted independently of the speed at which said piston means is driven during said advancing stroke, to thereby facilitate operation of said food product pump so that said piston means can be operated at a substantially constant speed during each said advancing stroke, while the time period for each pump cycle can be selectively varied.

3. An apparatus for filling containers in association with claim 1, wherein said food product pump includes a plurality of said pump chambers and a plurality of said pump piston means movable in tandem, each in a respective one of said pump chambers, said pump further including a plurality of said pump valve means operable in tandem in respective association with said pump chambers and piston means.

4. An apparatus for filing containers in accordance with claim 1, including pump piston cam means driven by said servo-controlled drive means and operatively connected to said pump piston means for effectively driven movement thereof, and valve actuating cam means driven by said servo-controlled drive means and operably connected to said pump valve means for effecting movement thereof between said first and second positions.

5. An apparatus for filling containers in accordance with claim 4, including camshaft means driven by said servo-controlled drive means, said pump piston cam means and said valve actuating can means being commonly mounted on said camshaft means.

6. A method of filling containers being conveyed by an associated container conveyor, comprising the steps of:

providing a supply of food product;

positioning a food product pump having an outlet in operative association with said conveyor, wherein said pump includes a housing defining a pump chamber, and a pump piston means reciprocably movable in said pump chamber to provide retraction and advancing strokes during each pumping cycle;

providing said food product pump with pump valve means operable in cooperation with said pump piston means, and moving said pump valve means between a first position wherein said pump chamber is joined in fluid communication with said food product supply during said retraction stroke of said piston means, and a second position wherein said pump chamber is joined in fluid communication with said outlet during said advancing stroke of said piston means; and moving said pump piston means with servo-controlled drive means operatively connected to said piston means so that during each pumping cycle: (1) food product is received in said pump chamber from said supply during said retractions stroke of said piston means, and (2) food product is moved from said pump chamber from said supply during said retraction stroke of said containers during said advancing stroke of said piston means, said servo-controlled drive means being operated to control the pump cycle of said food product pump independently of the speed at which said containers are being moved by said associated container conveyor.

7. A method of filling container in accordance with claim 6, including operating said servo-controlled drive means to selectively adjust the speed at which said pump piston means is driven during said retraction stroke independently of the speed at which said piston means is driven during said advancing stroke, to thereby facilitate operation of said food product pump so that said piston means can be operated at a substantially constant speed during each said advancing stroke, while the time period for each pump cycle can be selectively varied.

8. A method of filling containers in accordance with claim 6, including providing pump piston cam means operatively connected to said pump piston means for effecting driven movement thereof;

providing valve actuating cam means operatively connected to said pump valve means for effecting movement thereof between said first and second positions; and driving said pump piston cam means and said valve actuating cam means with said servo-controlled drive means.

* * * * *

UNITED STATES PATENT AND TRADEMARK OFFICE

CERTIFICATE OF CORRECTION

PATENT NO. : 5,127,449

DATED : July 7, 1992

INVENTOR(S) : Martin J. Mueller, Martin Mueller, and Michael J. Weigandt

It is certified that error appears in the above-identified patent and that said Letters Patent is hereby corrected as shown below:

In column 2, line 40, the number "35" should be deleted;

In column 5, line 19, "180" should be --180°

In column 7, line 41, the word "can" should be --cam--;

In column 8, line 17, the word "retractions" should be --retraction--;

lines 19-20, delete the words "from said supply during said retraction stroke" and replace with --by said piston means and through said outlet into one--;

Signed and Sealed this

Fourteenth Day of December, 1993

Bruce Lehman

BRUCE LEHMAN

*Commissioner of Patents and Trademarks*

*Attest:*

*Attesting Officer*